US012203723B2

(12) United States Patent
McPherson et al.

(10) Patent No.: US 12,203,723 B2
(45) Date of Patent: Jan. 21, 2025

(54) ARCHERY BOW ACCESSORY ATTACHMENT

(71) Applicant: MCP IP, LLC, Sparta, WI (US)

(72) Inventors: Mathew A. McPherson, Norwalk, WI (US); Brandon J. Gann, Sparta, WI (US); Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 38 days.

(21) Appl. No.: 18/096,490

(22) Filed: Jan. 12, 2023

(65) Prior Publication Data

US 2023/0243616 A1 Aug. 3, 2023

Related U.S. Application Data

(60) Provisional application No. 63/425,241, filed on Nov. 14, 2022, provisional application No. 63/300,985, filed on Jan. 19, 2022.

(51) Int. Cl.
*F41B 5/14* (2006.01)

(52) U.S. Cl.
CPC ..... *F41B 5/148* (2013.01); *F41B 5/14* (2013.01); *F41B 5/1426* (2013.01); *F41B 5/1442* (2013.01)

(58) Field of Classification Search
CPC ..... F41B 5/148; F41B 5/14; F41B 5/1403; F41B 5/1426; F41B 5/1442; F41B 5/1484; F41B 5/1488; F41B 5/1492; F41B 5/1496
USPC ..... 124/86, 88, 89
See application file for complete search history.

(56) References Cited

U.S. PATENT DOCUMENTS

| | | | | | |
|---|---|---|---|---|---|
| 2,909,167 | A | | 10/1956 | Fredrickson | |
| 3,406,675 | A | | 10/1968 | Fredrickson | |
| 3,491,739 | A | | 1/1970 | Scrobell | |
| 4,329,972 | A | * | 5/1982 | Wilson | F41B 5/1469 124/24.1 |
| 4,452,222 | A | | 6/1984 | Quartino et al. | |
| 4,759,337 | A | | 7/1988 | Suski | |
| 4,788,961 | A | | 12/1988 | Toth | |
| 4,893,606 | A | | 1/1990 | Sisko | |
| 5,005,554 | A | | 4/1991 | Shepley et al. | |
| 5,072,716 | A | | 12/1991 | Sappington | |
| 5,123,396 | A | | 6/1992 | Shepley et al. | |
| 5,243,957 | A | * | 9/1993 | Neilson | F41B 5/1469 124/31 |
| 5,379,746 | A | * | 1/1995 | Sappington | F41G 1/467 124/87 |
| 5,400,764 | A | * | 3/1995 | Spolar | F41G 1/467 124/87 |
| 5,433,792 | A | * | 7/1995 | Darlington | F41B 5/10 124/88 |
| 5,553,597 | A | * | 9/1996 | Sparks | F41B 5/1438 124/44.5 |
| 5,657,740 | A | * | 8/1997 | Slates | F41G 1/467 124/87 |
| 5,803,070 | A | | 9/1998 | Martin et al. | |

(Continued)

*Primary Examiner* — John E Simms, Jr.
(74) *Attorney, Agent, or Firm* — Laabs Intellectual Property

(57) ABSTRACT

In some embodiments, an archery bow comprises a riser comprising a first rail and a second rail. An accessory is supported by the riser. The accessory extends through the first rail and contacts the second rail. A fastener contacts the riser and the accessory. The fastener comprises a central axis that does not intersect the accessory.

12 Claims, 9 Drawing Sheets

(56) References Cited

U.S. PATENT DOCUMENTS

| | | | | |
|---|---|---|---|---|
| 5,904,134 | A | 5/1999 | Denbow | |
| 5,934,266 | A | 8/1999 | Martin et al. | |
| 5,944,004 | A | 8/1999 | Goff et al. | |
| 6,085,736 | A * | 7/2000 | Osterhues | F41B 5/1426 124/89 |
| RE36,942 | E | 11/2000 | Shepley, Jr. et al. | |
| 6,142,134 | A | 11/2000 | Meeks | |
| 6,430,822 | B1 | 8/2002 | Slates | |
| 6,568,382 | B2 | 5/2003 | Martin et al. | |
| 6,715,481 | B1 * | 4/2004 | Anderson | F41B 5/143 124/90 |
| 6,889,683 | B1 | 5/2005 | Smith | |
| 6,895,676 | B1 | 5/2005 | Mendyk | |
| 6,925,721 | B2 | 8/2005 | Dietz | |
| 6,938,616 | B2 | 9/2005 | Walk | |
| 6,968,837 | B1 | 11/2005 | Shepley, Jr. et al. | |
| 7,066,165 | B2 | 6/2006 | Perry | |
| 7,347,196 | B1 | 3/2008 | Shepley, Jr. et al. | |
| 7,958,881 | B2 | 6/2011 | Silverson | |
| 7,987,842 | B2 | 8/2011 | McPherson | |
| 7,997,261 | B2 | 8/2011 | Scaniffe | |
| 8,225,778 | B2 | 7/2012 | Walk et al. | |
| 8,347,870 | B1 | 1/2013 | Mahutga | |
| 8,408,195 | B2 | 4/2013 | McPherson | |
| 8,689,454 | B2 * | 4/2014 | Pulkrabek | F41G 1/467 124/87 |
| 8,839,775 | B2 | 9/2014 | Wasilewski | |
| 9,097,491 | B2 * | 8/2015 | Summers | F41G 1/467 |
| 9,400,154 | B2 | 7/2016 | McPherson | |
| 9,429,383 | B2 | 8/2016 | Martens | |
| 9,752,843 | B2 | 9/2017 | Garver et al. | |
| 10,024,630 | B2 | 7/2018 | Donovan | |
| 10,077,964 | B2 | 9/2018 | Summers | |
| 10,295,296 | B2 | 5/2019 | Summers | |
| 10,330,424 | B2 | 6/2019 | Brown | |
| 10,393,471 | B2 | 8/2019 | McPherson et al. | |
| 10,619,966 | B2 | 4/2020 | Ozanne et al. | |
| 10,634,448 | B2 | 4/2020 | Brown | |
| 11,293,716 | B1 | 4/2022 | Dahl | |
| 11,549,784 | B2 | 1/2023 | Brown | |
| 11,885,588 | B2 | 1/2024 | McPherson et al. | |
| 12,013,205 | B2 | 6/2024 | McPherson et al. | |
| 2009/0107474 | A1 | 4/2009 | Silverson | |
| 2011/0192385 | A1 * | 8/2011 | Clark | F41B 5/10 124/88 |
| 2012/0260902 | A1 * | 10/2012 | Felt | F41B 5/1426 124/89 |
| 2015/0013658 | A1 * | 1/2015 | Gibson | F41B 5/148 124/88 |
| 2015/0184973 | A1 * | 7/2015 | Martens | F41B 5/00 124/88 |
| 2020/0208938 | A1 | 7/2020 | Brown | |
| 2020/0340774 | A1 | 10/2020 | Summers | |
| 2021/0254923 | A1 | 8/2021 | Summers et al. | |
| 2022/0276019 | A1 | 9/2022 | Summers et al. | |
| 2023/0221094 | A1 | 7/2023 | Yan | |
| 2023/0243616 | A1 | 8/2023 | McPherson et al. | |

* cited by examiner

ARCHERY BOW ACCESSORY ATTACHMENT

CROSS-REFERENCE TO RELATED APPLICATIONS

This application claims the benefit of U.S. Patent Application No. 63/300,985, filed Jan. 19, 2022, the entire content of which is hereby incorporated herein by reference. This application claims the benefit of U.S. Patent Application No. 63/425,241, filed Nov. 14, 2022, the entire content of which is hereby incorporated herein by reference.

BACKGROUND OF THE INVENTION

This invention relates to archery bows and accessories for archery bows. Archery bows are generally known and used to launch arrows. Archery bows are often fitted with various accessories, such as stabilizers, arrow rests, sights, vibration dampers, etc.

Although there is a general desire for a bow to be as small and light as possible, each accessory tends to add weight and bulk, increasing the profile of the bow. Some users remove accessories from a bow when the bow is being configured for travel or storage, for example to allow the bow to fit in a case. Certain accessories are more critical to bow accuracy than others, and the specific placement and orientation of the accessory with respect to the bow riser can be very important. When an accessory is removed and later reinstalled, the specific placement and orientation can change due to tolerances and clearances of parts. If an accessory is attached with multiple screws, even the order of tightening the screws can change the specific placement of the accessory.

Certain accessories intentionally add mass to the bow assembly, such as stabilizers. It is desirable for a stabilizer to be attached to a bow using a strong and rigid connection.

There remains a need for novel archery bow accessory attachment structures that improve upon prior bow structures. There remains a need for archery bow systems that reduce the weight and profile of the bow. There remains a need for archery bow systems that allow an accessory to be removed and reinstalled in the same specific location. There remains a need for stronger attachment mechanisms between an archery bow and an accessory.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser comprising a first rail and a second rail. An accessory is supported by the riser. The accessory extends through the first rail and contacts the second rail. A fastener contacts the riser and the accessory. The fastener comprises a central axis that does not intersect the accessory.

In some embodiments, the fastener comprises a wedging surface contacting the accessory, the wedging surface oriented at an angle to the central axis.

In some embodiments, the fastener comprises a crank handle.

In some embodiments, the accessory comprises an octagonal cross-sectional shape.

In some embodiments, the first rail comprises a first aperture and the accessory is positioned in the first aperture.

In some embodiments, the second rail comprises a second aperture and the accessory is positioned in the second aperture.

In some embodiments, the first aperture and the second aperture comprise the same shape. In some embodiments, the first aperture comprises an asymmetrical cross-sectional shape.

In some embodiments, the accessory comprises a plurality of detents and the fastener contacts a detent.

In some embodiments, an archery bow comprises a riser comprising a first rail and a second rail. A stabilizer is supported by the riser. The stabilizer extends through the first rail and contacts the second rail.

In some embodiments, a fastener contacts the riser and the stabilizer. In some embodiments, the fastener comprises a central axis that does not intersect the stabilizer.

In some embodiments, a fastener comprises a wedging surface contacting the stabilizer. In some embodiments, the wedging surface is oriented at an angle to the central axis.

In some embodiments, a fastener comprises a crank handle.

In some embodiments, a stabilizer comprises a plurality of detents and the fastener contacts a detent.

In some embodiments, the bow comprises a shooting axis and a grip. In some embodiments, the grip and the stabilizer are located to a common side of the shooting axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
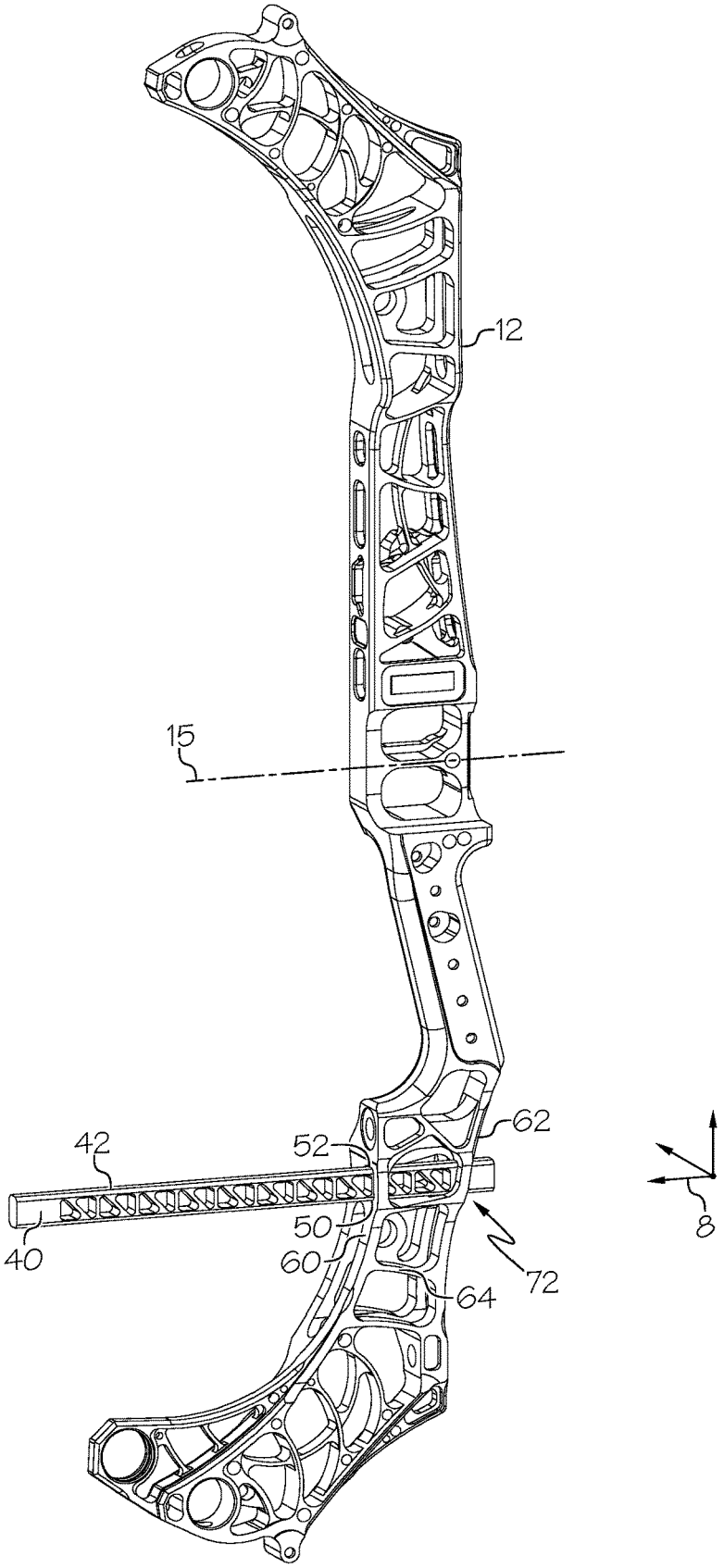
FIG. 1 shows an embodiment of an archery bow riser.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow riser 12. Desirably, the riser 12 is suitable to comprise an archery bow, for example comprising limbs and a bowstring.

In some embodiments, the riser 12 comprises a cavity 50 arranged to receive an accessory 40. In some embodiments, an accessory 40 comprises a stabilizer.

In some embodiments, an accessory 40 comprises a mounting bar 42 and the mounting bar 42 is oriented in the cavity 50. In some embodiments, a length of the mounting bar 42 is greater than a distance across the riser 12. In some embodiments, a mounting bar 42 positioned in the cavity 50 can protrude from the riser 12 on opposites sides of the cavity 50. In some embodiments, a first outer surface of the riser 12 comprises a first aperture 52 and a second outer surface of the riser 12 comprises a second aperture 72. In some embodiments, an accessory 40 can be attached to the riser 12 with a portion of the accessory 40 oriented in the first aperture 52 and another portion of the accessory 40 oriented in the second aperture 72.

In some embodiments, a fastener 58 is used to secure the accessory 40 with respect to the riser 12.

Figure 2:
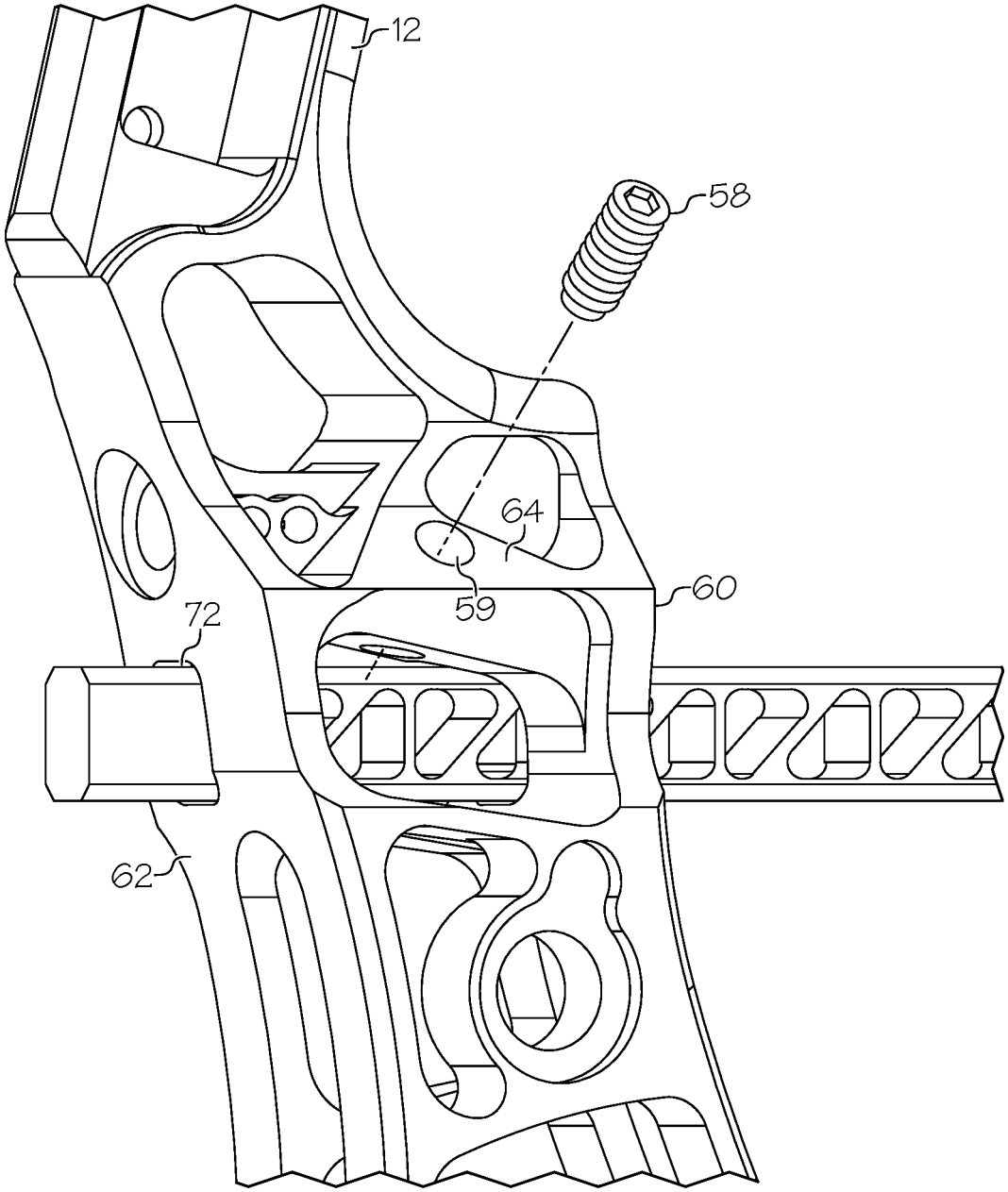
FIG. 2 shows a detail of an embodiment of an accessory engaged with a riser.
Figure 3:
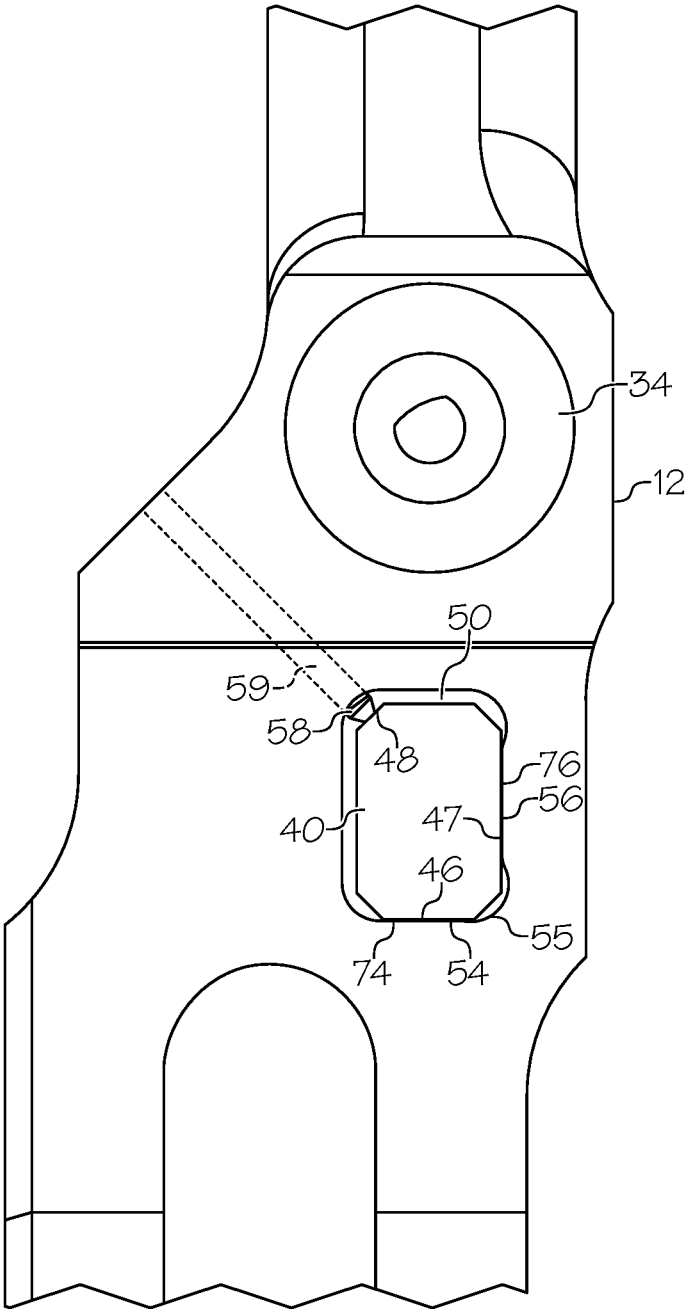
FIG. 3 shows an end view of an embodiment of a riser.

FIGS. 2 and 3 show an embodiment of a riser 12 and an embodiment of an accessory 40 in greater detail. In some embodiments, a riser 12 comprises an accessory bushing 34, for example as described in U.S. Pat. No. 11,181,335. In some embodiments, an accessory such as a stabilizer can be attached to the accessory bushing 34, for example using a threaded stud arranged to engage complimentary threads in the bushing 34. In some embodiments, the riser 12 further comprises a cavity 50 as described herein for receiving an accessory 40, such as a stabilizer, without using a threaded stud.

In some embodiments, an accessory 40 comprises a mounting bar 42. In some embodiments, a mounting bar 42 can comprise any suitable cross-sectional shape.

In some embodiments, the riser 12 is configured to engage a fastener 58 arranged to tighten against the accessory 40. In some embodiments, the riser 12 comprises a threaded cavity 59 arranged to receive and engage the fastener 58. In some embodiments, the fastener 58 is arranged to extend into the cavity 50. In some embodiments, the fastener 58 engages a detent 43 of the accessory 40.

In some embodiments, the fastener 58, and the threaded cavity 59, are oriented at a non-zero, non-orthogonal angle to one or more of the three mutually perpendicular coordinate axes 8. For example, if a shooting axis 15 of the bow 10 extends along a z-axis, then the fastener 58 shown in FIG. 3 is oriented at a non-zero angle to the x-axis and to the y-axis. In some embodiments, the fastener 58, and the threaded cavity 59, are oriented at a non-zero, non-orthogonal angle to at least two of the three mutually perpendicular coordinate axes 8.

In some embodiments, a central axis 68 of the fastener 58 extends into the cavity 50. In some embodiments, the central axis 68 of the fastener 58 is arranged to intersect the accessory 40.

In some embodiments, a riser 12 comprises integral structural members and various cells. In some embodiments, a riser 12 comprises a first rail 60 defining a first surface (e.g. front surface) of the riser 12 and a second rail 62 defining a second surface (e.g. rear surface) of the riser 12. In some embodiments, under the loading experienced in a brace condition of the bow 10, the first rail 60 comprises a tension rail and the second rail 62 comprises a compression rail.

In some embodiments, the riser 12 comprises a plurality of connecting members 64. In some embodiments, connecting members 64 extend between the first rail 60 and the second rail 62. In some embodiments, a connecting member 64 extends between a rail 60, 62 and another connecting member 64. In some embodiments, a connecting member 64 extends between other connecting members 64. In some embodiments, a connecting member 64 comprises the threaded cavity 59.

In some embodiments, the cavity 50 comprises a first aperture 52 formed in the first rail 60. In some embodiments, the first aperture 52 comprises a plurality of support portions arranged to support an accessory 40. In some embodiments, the first aperture 52 comprises a first support portion 54. In some embodiments, the first aperture 52 comprises a second support portion 56 spaced apart from the first support portion 54. In some embodiments, the first support portion 54 is oriented at an angle to the second support portion 56.

In some embodiments, the cavity 50 comprises a second aperture 72 formed in the second rail 62. In some embodiments, the second aperture 72 comprises a plurality of support portions arranged to support an accessory 40. In some embodiments, the second aperture 72 comprises a first support portion 74. In some embodiments, the second aperture 72 comprises a second support portion 76 spaced apart from the first support portion 74.

In some embodiments, the first support portion 54 of the first aperture 52 and the first support portion 74 of the second aperture 72 comprise similar shapes. In some embodiments, a shape of the first aperture 52 is similar to a shape of the second aperture 72.

In some embodiments, a first support portion 54, 74 and a second support portion 56, 76 are arranged to self-align an accessory 40 with respect to the riser 12 when loaded by the fastener 58. In some embodiments, the accessory 40 contacts portions of the support portions 54, 56 that comprise diverging surfaces. In some embodiments, the accessory 40 contacts portions of the support portions 54, 56 having tangents that are diverging. In some embodiments, the fastener 58 is located within an angle defined by the support portions 54, 56.

In some embodiments, an accessory 40 comprises a first surface 46, a second surface 47 and a third surface 48. In some embodiments, the first surface 46 contacts a first support portion 54 and the second surface 47 contacts a second support portion 56 the first aperture 52, but the accessory 40 does not contact any other portion of the first aperture 52. In some embodiments, the fastener 58 contacts the third surface 48. In some embodiments, the third surface 48 is oriented at a non-zero angle to the first surface 46 and is oriented at a non-zero angle to the second surface 47.

In some embodiments, the first surface 46 is oriented in an orthogonal plane defined by two of the three mutually perpendicular coordinate axes 8. For example, in some embodiments, the first surface 46 is oriented in an X-Z plane. In some embodiments, the second surface 47 is oriented in an orthogonal plane defined by two of the three mutually perpendicular coordinate axes 8. For example, in some embodiments, the second surface 47 is oriented in a Y-Z plane. In some embodiments, the first surface 46 is orthogonal to the second surface 47. In some embodiments, the third surface 48 is oriented non-parallel to each of the three reference planes defined by the three mutually perpendicular coordinate axes 8.

In some embodiments, a first angle is defined between the first surface 46 and the third surface 48. In some embodiments, a second angle is defined between the second surface 47 and the third surface 48. In some embodiments, the first angle is equal to the second angle. In some embodiments, the first angle is different from the second angle. In some embodiments, a sum of the first angle plus the second angle equals 90 degrees.

In some embodiments, the first aperture 52 comprises an enlarged portion 55 located between the first support portion 54 and the second support portion 56. In some embodiments, the enlarged portion 55 does not contact an accessory 40 oriented in the first aperture 52. In some embodiments, the enlarged portion 55 is concave with respect to the first aperture 52.

In some embodiments, an accessory 40 comprises an octagonal cross-sectional shape.

Figure 4:
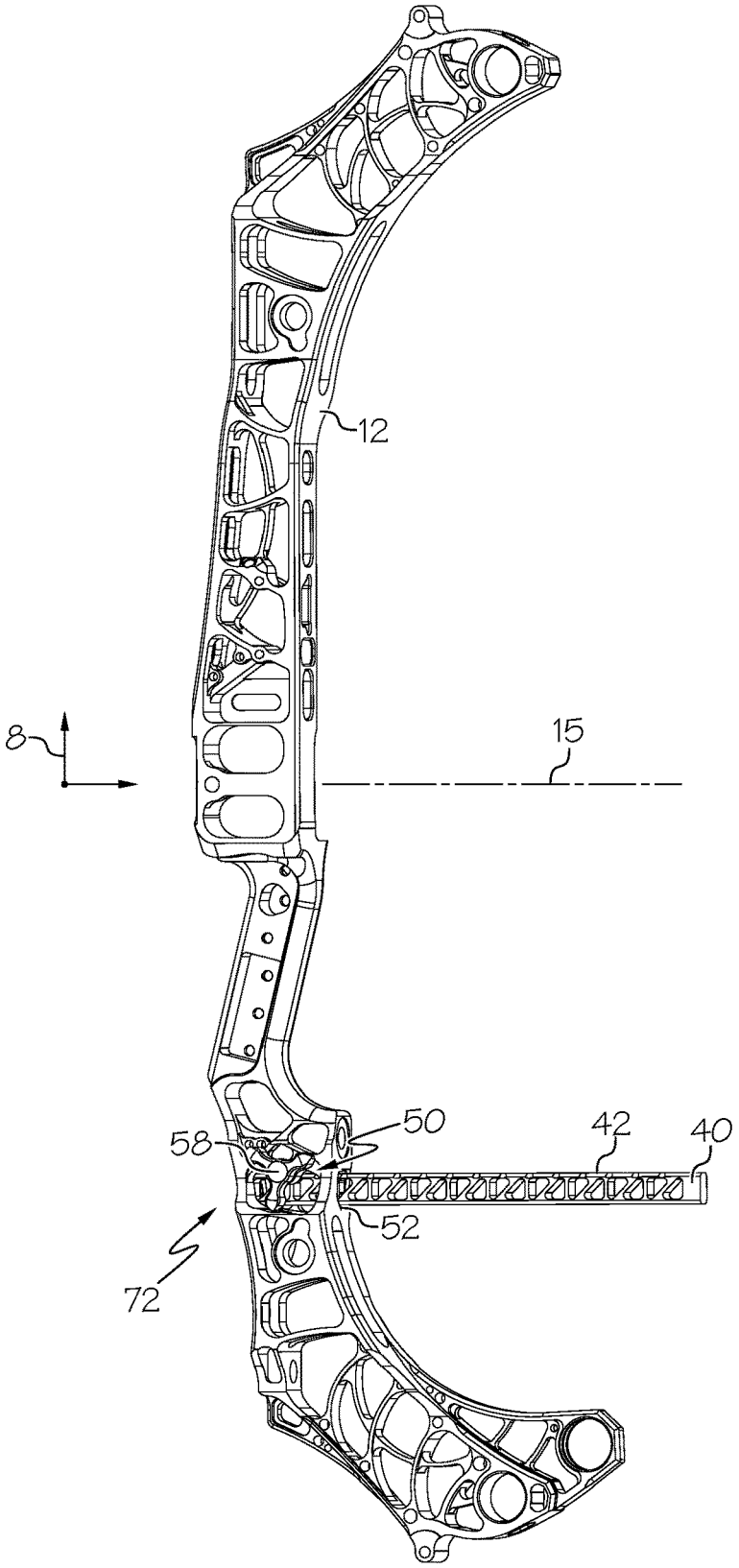
FIGS. 4-6 show another embodiment of a riser engaging an accessory.
Figure 5:
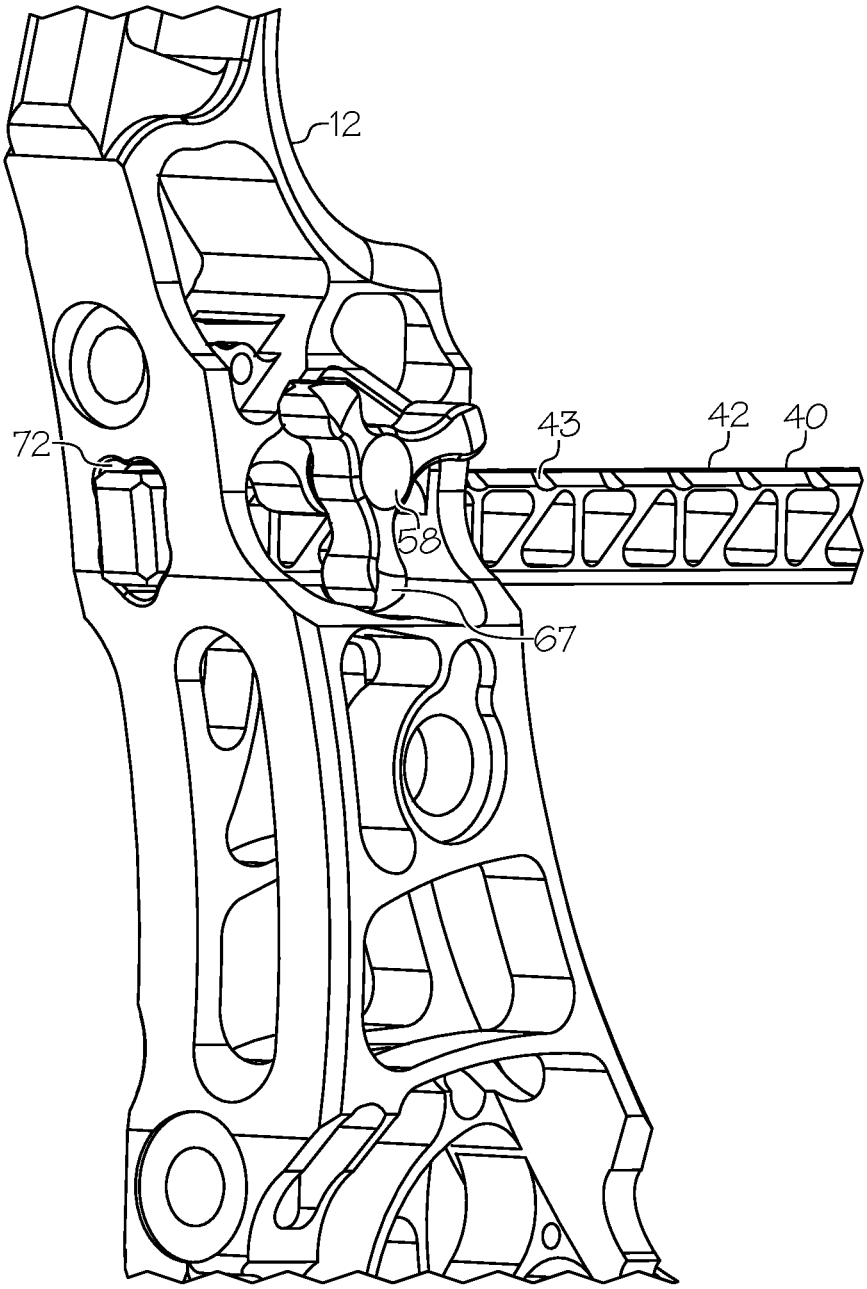
Figure 6:
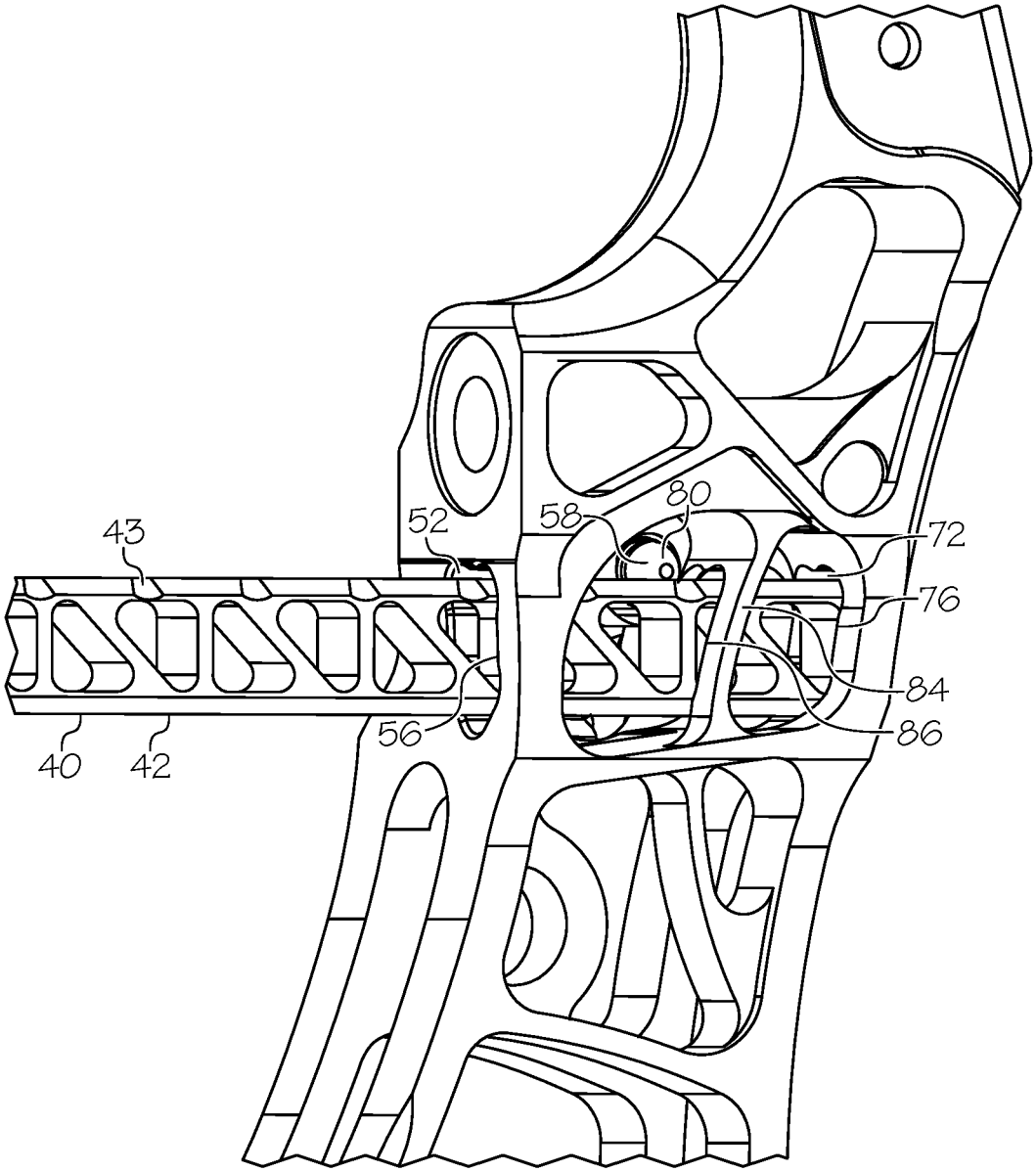
Figure 7:
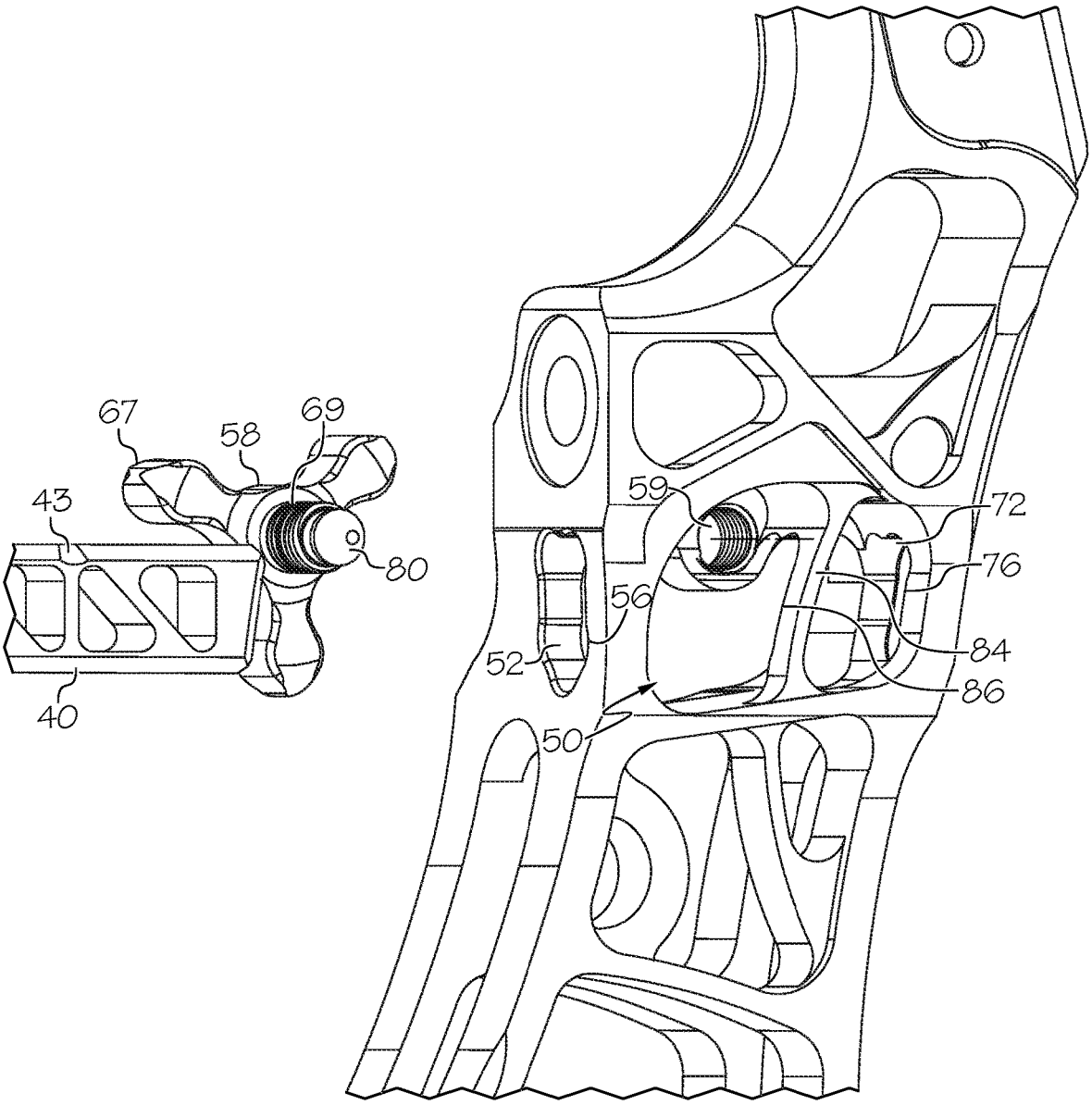
FIGS. 7 and 8 show exploded views of the embodiment shown in FIGS. 4-6.
Figure 8:
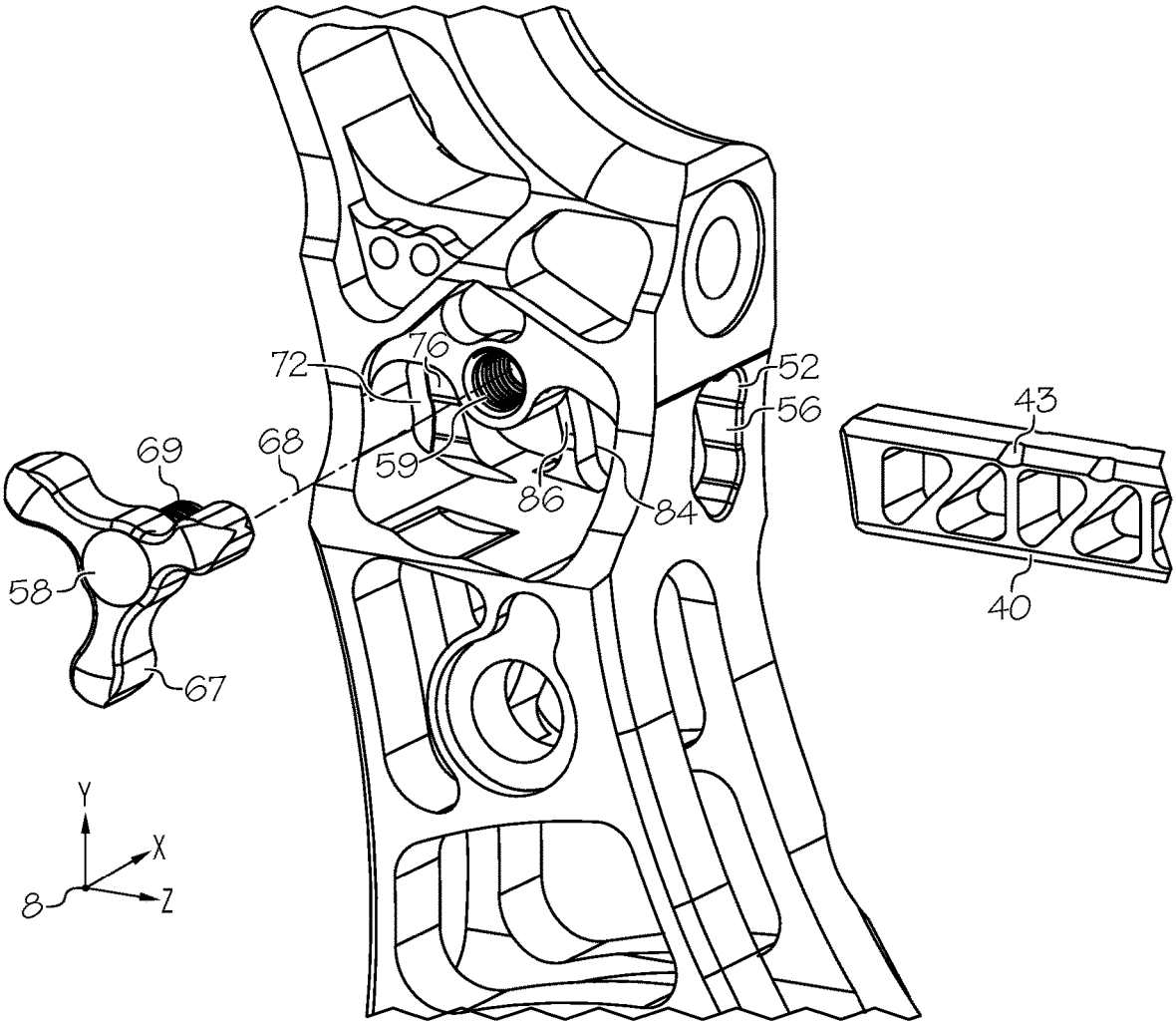
Figure 9:
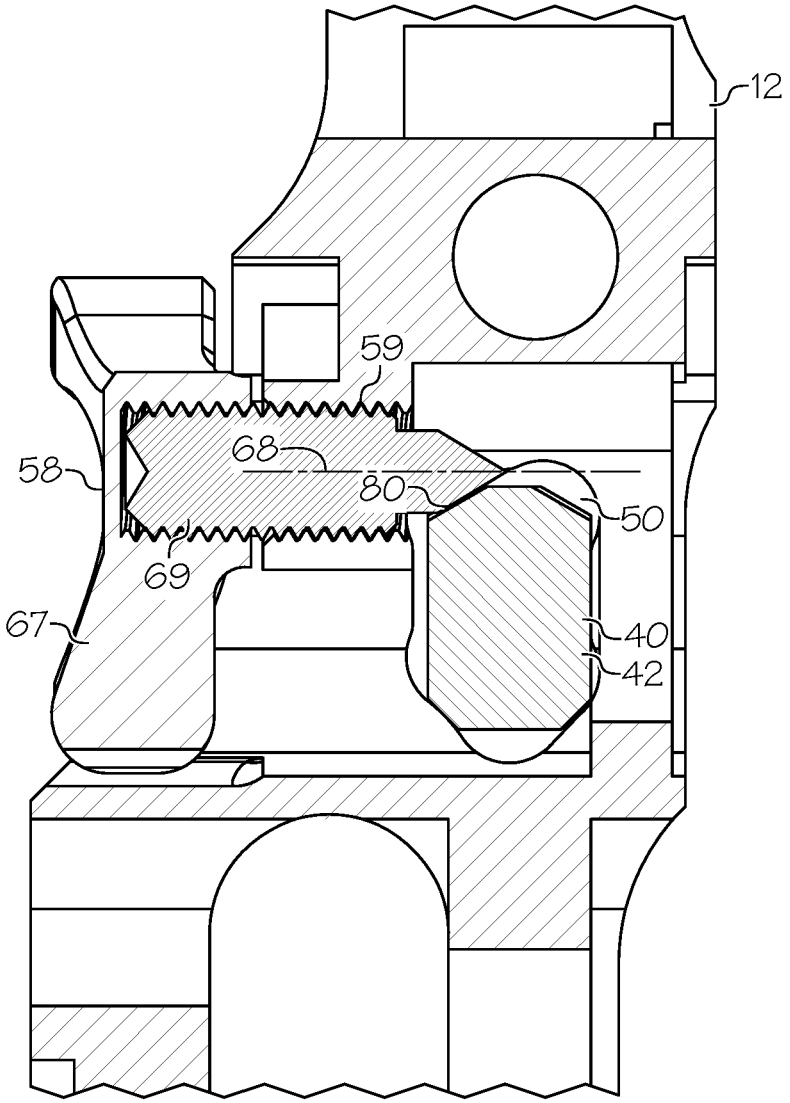
FIG. 9 shows a cross-sectional view of the embodiment shown in FIGS. 4-6.

FIGS. 4-6 show another embodiment of an archery bow riser 12, and FIGS. 7 and 8 show exploded views. FIG. 9 shows a cross-sectional view. Desirably, the riser 12 is suitable to comprise an archery bow, for example comprising limbs and a bowstring. In some embodiments, the riser 12 comprises a cavity 50 arranged to receive an accessory 40. In some embodiments, a fastener 58 is used to secure the accessory 40 with respect to the riser 12.

In some embodiments, a fastener 58 is constructed and arranged to attach the accessory 40 to the riser 12 without using a tool such as a driver or allen wrench. In some embodiments, a fastener 58 is arranged to be turned by hand. In some embodiments, a fastener 58 comprises a crank handle 67. In some embodiments, a fastener 58 comprises a stem 69. In some embodiments, a crank handle 67 extends orthogonally to a central axis 68 of the fastener 58 and allows the fastener 58 to be rotated about the central axis 68. In some embodiments, a fastener 58 comprises multiple crank handles 67. In some embodiments, multiple crank handles 67 are equally distributed about the central axis 68.

In some embodiments, a fastener 58 comprises a wedging surface 80 oriented at an angle to the central axis 68 of the fastener 58. In some embodiments, a wedging surface 80 is arranged to abut an accessory 40. In some embodiments, a wedging surface 80 is arranged to engage a detent 43 on the accessory 40. In some embodiments, a wedging surface 80 is oriented non-parallel and non-orthogonal to the central axis 68 of the fastener 58. A wedging surface 80 can be oriented at any suitable angle to the central axis 68. In some embodiments, a wedging surface 80 is oriented at an angle to the central axis 68 of thirty degrees to sixty degrees. In some embodiments, a wedging surface 80 is oriented at an angle to the central axis 68 of forty degrees to fifty degrees. In some embodiments, the angle is forty-five degrees.

In some embodiments, a central axis 68 of the fastener 58 does not intersect the accessory 40. In some embodiments, the central axis 68 extends orthogonal to a longitudinal axis of the accessory 40. In some embodiments, the central axis 68 extends through a portion of the cavity 50 that is not occupied by the accessory 40.

In some embodiments, the fastener 58, and the threaded cavity 59, are oriented parallel to one of the three mutually perpendicular coordinate axes 8. For example, if a shooting axis 15 of the bow 10 extends along a z-axis, then the fastener 58 can be parallel to the x-axis. In some embodiments, a central axis 68 of the fastener 58 is oriented orthogonal to a shooting axis of the bow.

In some embodiments, the cavity 50 is defined by a first aperture 52 and a second aperture 72. In some embodiments, the cavity 50 is at least partially defined by a support member 84. In some embodiments, a support member 84 is generally aligned with the threaded cavity 59 along a length of the accessory 40, whereas the first aperture 52 and second aperture 72 may be offset from the threaded cavity 59 along a length of the accessory 40. In some embodiments, the support member 84 comprises a support surface 86 arranged to contact the accessory 40. In some embodiments, the support surface 86 helps prevent deformation of the accessory 40 when the fastener 58 is tightened. In some embodiments, the support surface 84 comprises a shape similar to the support portions 56, 76 of the first aperture 52 and second aperture 72, respectively. In some embodiments, the support surface 84 and the support portions 56, 76 are oriented on a common plane.

In some embodiments, the riser 12 comprises a grip. In some embodiments, the accessory 40 and the grip are located to a common side of the shooting axis 15. In some embodiments, the grip and the accessory 40 are located below the shooting axis 15. In some embodiments, an archery sight is oriented above the shooting axis 15. In some embodiments, the accessory 40 and an archery sight are located on opposite sides of the shooting axis 15.

In some embodiments, an accessory 40 comprises an archery bow stabilizer. In some embodiments, an accessory 40 is attached to the riser 12 at one end and is arranged to support weights at the other end.

The entire content of U.S. Patent Application No. 63/167,511, filed Mar. 29, 2021, U.S. Patent Application No. 63/300,985, filed Jan. 19, 2022, U.S. patent application Ser. No. 17/707,757, filed Mar. 29, 2022 and U.S. Patent Application No. 63/425,241, filed Nov. 14, 2022, are each hereby incorporated herein by reference.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention.

The invention claimed is:

1. An archery bow comprising:

a riser comprising a first rail and a second rail, the first rail comprising a first aperture comprising a first cross-sectional shape;

an accessory supported by the riser, the accessory extending through the first aperture, the accessory contacting the second rail, the accessory comprising a second cross-section shape, the second cross-sectional shape different from the first cross-sectional shape; and a fastener contacting the riser and the accessory, the fastener comprising a central axis, wherein the central axis does not intersect the accessory.

2. The archery bow of claim 1, the fastener comprising a wedging surface contacting the accessory, the wedging surface oriented at an angle to the central axis.

3. The archery bow of claim 1, the fastener comprising a crank handle.

4. The archery bow of claim 1, the second cross-sectional shape comprising an octagonal cross-sectional shape.

5. The archery bow of claim 1, the first cross-sectional shape being non-circular.

6. The archery bow of claim 5, the second rail comprising a second aperture, the accessory positioned in the second aperture.

7. The archery bow of claim 6, the first aperture and the second aperture comprising the same cross-sectional shape.

8. The archery bow of claim 5, the first cross-sectional shape comprising an asymmetrical cross-sectional shape.

9. The archery bow of claim 1, the accessory comprising a plurality of detents, the fastener contacting a detent.

10. The archery bow of claim 1, comprising:

a sight supported by the riser, the accessory comprising a stabilizer.

11. The archery bow of claim 10, comprising a shooting axis and a grip, wherein the grip and the stabilizer are located to a common side of the shooting axis.

12. The archery bow of claim 11, wherein the sight and the stabilizer are located on opposite sides of the shooting axis.

* * * * *